United States Patent [19]

Pabst

[11] Patent Number: 4,817,299

[45] Date of Patent: Apr. 4, 1989

[54] CONVECTION HEAT TREATING APPARATUS FOR THERMAL TREATMENT OF A TRAVELING SUBSTRATE

[75] Inventor: Manfred Pabst, Cologne, Fed. Rep. of Germany

[73] Assignee: A. Monforts GmbH & Co., Fed. Rep. of Germany

[21] Appl. No.: 85,524

[22] Filed: Aug. 14, 1987

[30] Foreign Application Priority Data

Aug. 16, 1986 [DE] Fed. Rep. of Germany ..... 3627904

[51] Int. Cl.[4] ..... F26B 13/00

[52] U.S. Cl. ..... 34/155; 34/158; 34/160

[58] Field of Search ..... 34/158, 155, 156, 160

[56] References Cited

U.S. PATENT DOCUMENTS

| | | | |
|---|---|---|---|
| 2,695,252 | 11/1954 | Nickelsen et al. | 34/156 X |
| 3,568,331 | 3/1971 | Loveday | 34/155 |
| 3,739,490 | 6/1973 | Comstock | 34/155 X |
| 4,094,077 | 6/1978 | Schrader et al. | 34/155 |
| 4,397,103 | 8/1983 | Ruepp | 34/155 |
| 4,498,250 | 2/1985 | Gaguer et al. | 34/155 |
| 4,516,332 | 5/1985 | Takaoka et al. | 34/160 X |
| 4,551,928 | 11/1985 | Gottschalk | 34/155 X |
| 4,621,440 | 11/1986 | Gierse et al. | 34/155 |

*Primary Examiner*—Steven E. Warner

*Attorney, Agent, or Firm*—Shefte, Pinckney & Sawyer

[57] ABSTRACT

Convection heat treating apparatus for thermal treatment of a traveling substrate that maintains the temperature of the treatment gas so as to eliminate formation of streaks in the substrate without overheating the interior walls of the machine. A pivotally mounted flow control means has integrally formed portions to simultaneously control the flow of treatment gas through an application chamber inlet, and adjacent branch opening which allows treatment gas to pass from a distribution chamber to return chamber for reheating and recirculation without passing through the application chamber and onto the fabric web, and a by-pass opening disposed radially outwardly from the branch opening which permits the treatment gas to pass directly to the circulation means without reheating. The flow control means is adapted to vary the opening of at lest one application chamber inlet between closed and open and to maintain the branch opening closed when the application chamber inlet is varied between open and partially opened to an intermediate extent, and to open the branch opening when the inlet is closed from the intermediate extent.

20 Claims, 3 Drawing Sheets

CONVECTION HEAT TREATING APPARATUS FOR THERMAL TREATMENT OF A TRAVELING SUBSTRATE

BACKGROUND OF THE INVENTION

The present invention relates to a convection heat treating apparatus for thermal treatment of a traveling substrate, such as the drying or heat setting of a traveling web of textile material with a treatment gas, and more particularly to a convection heat treating apparatus adapted to control the flow and temperature of the treatment gas for proper treatment of the traveling web.

Conventional convection drying or setting machines generally have application chambers extending over and under the surfaces of a traveling fabric web, a distribution chamber connected to the application chambers with a fan for circulating the treatment gas, and a return flow chamber following the application chambers in the direction of flow of the treatment gas created by the fan. The return flow chamber communicates with the distribution chamber and contains a heating arrangement for reheating the treatment gas for recirculation. The inlets of the application chambers have flow control valves and the distribution chamber generally has at least one by-pass opening leading to the fan and adjacent to the inlet of the application chamber. The flow control valves are moveable to open and close the inlets to vary the flow therethrough by movement between positions opening, closing, and varying the opening of the inlet. The flow control valve of an inlet having a by-pass opening adjacent thereto is generally adapted to open and close the inlet inversely to the opening and closing of the by-pass opening. In this manner, the thermal treatment of the fabric web is controlled, but not without some disadvantages.

The treatment gas in conventional machines is generally heated air, but the circulating air may be any gas used in such machines. With conventional machines which utilize gas to heat the circulation air, the burners must be turned down low when the fabric web is stopped and the circulating air must also be throttled by means of the flow control valves. This decreases the temperature of the treatment gas. When the fabric web is started again the treatment gas usually does not return to the proper temperature "under load" as fast as the possible acceleration of the fabric web to be treated. The result is inadequate setting, streaking of the fabric or other attenuated treatment of a portion of goods.

In the case of machines heated by circulating oil or steam, the treatment gas is also throttled and the energy supply is stopped when the fabric web is stopped. If there is no means to dissipate heat from the treatment gas heaters, the temperature of the surfaces of the machine in the vicinity where heating occurs can increase sharply due to the build up of heat of the heating medium. Therefore, when the machine is restarted, the treatment gas is heated to a temperature beyond the normal value and the result can be overheating and excess setting of the fabric web.

Known prior art convection drying or setting machines are disclosed in British Pat. No. 235,402 and West German Pat. No. 3,336,331. The British patent involves forcing the circulating air by a blower through a radiator into an application chamber. A by-pass is provided to take the radiator out of the path of circulation of the treatment gas. Thus, the treatment gas changes almost instantaneously from heated to cool circulating air. As previously described, when the fabric web is restarted, and the radiator is switched back into the path of circulation, there will be a delay until the treatment gas regains its proper temperature during which time improper treatment of a portion of the goods will result. The West German patent describes a generic machine which has the objective of avoiding the pronounced streakiness which results in sensitive fabrics such as knitted fabrics when the machine is stopped and started without adjusting the temperature of the treatment gas. This patent provides a by-pass opening adjacent each application chamber inlet that communicates directly with the return flow chamber. The by-pass opening thus permits the treatment gas to pass directly into the return flow chamber without impacting upon the fabric web. Each inlet and by-pass opening has a common flow control valve moveable for partial or complete closure of the application chamber inlet inversely to the adjacent by-pass opening. Thus, the temperature of the treatment gas may be maintained at the value set for normal treatment during stoppage of the fabric web and the treatment gas is directed by the flow control valve into the return flow chamber for reheating without coming into contact with the fabric. There is no change in the heating of the treatment gas, however, and it is blown with the full force imparted by the fan against internal machine components not intended to be heated, particularly the roof and especially the side door of the machine. Overheating can eventually occur when the machine is stopped, resulting in adverse treatment of the fabric web.

SUMMARY OF THE INVENTION

The objective of the present invention is to protect the fabric web from streakiness when a machine of the general type described above is stopped and to maintain the temperature of the treatment gas without the risk of overheating internal machine components or the roof and side door.

The present invention meets this objective and overcomes the disadvantages of the prior art by providing a branch opening to permit passage of the treatment gas directly to the return flow chamber for reheating without passing into the application chamber and onto the fabric web and by providing a flow control means adapted to vary the opening of the application chamber inlets between open and closed for control of the flow of treatment gas therethrough. The flow control means maintains the branch opening closed when the inlet opening of at least one application chamber is varied between fully open and partially open to an intermediate extent, preferably approximately half of the fully open condition and progressively opens the branch opening when the inlet opening is progressively closed from the intermediate extent. In this manner, when the application chamber inlet is closed beyond the intermediate extent, the branch opening opens to allow a partial stream of treatment gas to flow into the return flow chamber for reheating, so that the treatment gas is maintained at the desired temperature with a lesser flow of gas on the fabric web. The branch opening is maintained closed until the application chamber inlet is closed to the intermediate extent, preferably more than approximately half its fully open condition, so that treatment gas can be throttled without by-passing any of the treatment gas through the branch opening. If the branch opening were constantly open during such continuous throttle operation, hot treatment gas circulating through the branch opening would result in undesirable heating of internal machine components, walls and doors as previously described.

Briefly described, the convection heating apparatus of the present invention includes a generic machine comprising an enclosure with a pair of application chambers arranged in spaced parallel facing relation with the traveling web of fabric being disposed therebetween, a distribution chamber communicating with the application chamber via the inlets of the application chamber and containing a circulating means, preferably a fan, a return flow chamber, preferably containing a heating means, to receive the treatment gas after it impacts the traveling fabric web to reheat the treatment gas and allow it to flow back to the fan for recirculation, and a flow control means for regulating the flow of treatment gas from the distribution chamber into the application chambers.

Preferably, the distribution chamber incorporates a branch opening. The branch opening allows passage of treatment gas from the distribution chamber to an opening in the return flow chamber without passing through the application chambers and onto the fabric web for treatment, so that a partial stream of treatment gas may be reheated to maintain the normal operating temperature of the treatment gas when the traveling fabric web is stopped.

The flow control means is adapted to vary the opening of at least one application chamber inlet opening, preferably the lower application chamber inlet, between closed and open and to maintain the branch opening closed when the application chamber inlet is varied between open and partially opened to an intermediate extent, and to open the branch opening when the inlet is closed from the intermediate extent.

Preferably, the flow control means includes an application chamber inlet control portion and a branch opening control portion. The inlet control portion is moveable to open and close the inlet and to vary the flow through the inlet opening by movement of the control portion by conventional actuating means, such as a motor drive, between positions opening, closing and varying the opening of the inlet. The branch opening control portion is moveable to open and close the branch opening to vary the flow therethrough and includes a segment to maintain the branch opening closed during movement of the branch opening control portion in correspondence with the movement of the inlet control portion between the inlet control portion's positions for opening the inlet and opening the inlet to an intermediate extent, preferably midway between positions for opening and closing the inlet opening. When the inlet control portion is moved to positions beyond the intermediate extent for progressively closing the inlet opening, and the flow of treatment gas into the application chambers is substantially attenuated or completely stopped, the branch opening control portion moves to positions for progressively opening the branch opening so that an increasing volume of the treatment gas is permitted to enter the return flow chamber for reheating to maintain the proper temperature of the treatment gas. The inlet control portion and the branch control portion are preferably integrally formed and pivotally mounted in the distribution chamber proximal the inlet opening and branch opening to effect control of the flow of the treatment gas as just described. In the preferred embodiment, the segment of the branch opening control portion has an arcuate surface of limited extent and the branch opening has a corresponding arcuate surface. The arcuate surfaces are disposed in adjacent opposed facing relation to close the branch opening when the application chamber inlet control portion is in position to completely open the inlet. The arcuate surface of the segment engages the arcuate surface of the branch opening to seal the opening closed and is adapted for movement in relation to the arcuate surface of the opening while maintaining the opening substantially closed during pivotal movement of the branch control portion when the application chamber inlet control portion is positioned to vary the inlet opening between open and open to the intermediate extent.

In the preferred embodiment of the present invention, a means for heating the treatment gas is provided in the return flow chamber, and a by-pass opening is incorporated in the distribution chamber adjacent the circulating means. The by-pass opening permits at least a portion of the treatment gas to pass in a shortcircuit from the distribution chamber to the fan for recirculation without being heated. When the application chamber inlet is substantially or completely blocked by the inlet control portion and the branch opening is open to allow a partial stream of the treatment gas to flow to the return flow chamber for heating and for recirculation by the fan, as previously described, the treatment gas is held at the desired temperature by admixing this heated gas to the short-circuit gas stream passing through the by-pass opening. Since little heat is dissipated to the outside from this short-circuit loop, only a small amount of the treatment gas is required to pass through the branch opening for reheating in order to maintain the temperature of the treatment gas. A branch opening having a cross-section of about 10% of the cross-section of the by-pass opening has proven to be sufficient for this purpose.

The control means incorporates a by-pass opening control portion which is moveable to open and close the by-pass opening. In this fashion, the by-pass opening control portion varies the flow of treatment gas through the opening by movement between positions opening, closing and varying the opening of the by-pass opening, inversely to the opening, closing and varying of the inlet opening of the application chamber by the inlet control portion. The application chamber inlet control portion, the branch opening control portion and the by-pass opening control portion of the preferred embodiment are all integrally formed to define an integral control member. The control member is pivotally mounted intermediate the lower application chamber inlet and branch opening with the by-pass opening being disposed radially outwardly from the branch opening to provide opening and closing of the application chamber inlet inversely to the opening and closing of the branch opening and by-pass opening by pivotal movement of the control member for flow and temperature control of the treatment gas.

An inlet control portion associated with the upper application chamber inlet may vary the opening and closing of the inlet opening either independently or in cooperation with the inlet control portion integrally formed with the branch opening control portion and the by-pass opening control portion to control the flow of treatment gas therethrough.

Other and further advantages and features of the present invention will be apparent from the accompanying drawings and the following detailed description of the preferred embodiment.

DESCRIPTION OF THE PREFERRED EMBODIMENT

For the sake of simplicity and clarity, reference is made in the following to a tenter frame with a horizontal fabric web width. The invention can, however, be applied in the same way to other horizontal drying or setting machines and, of course, to festoon drying or setting machines with a quite similar design principle.

Figure 1:
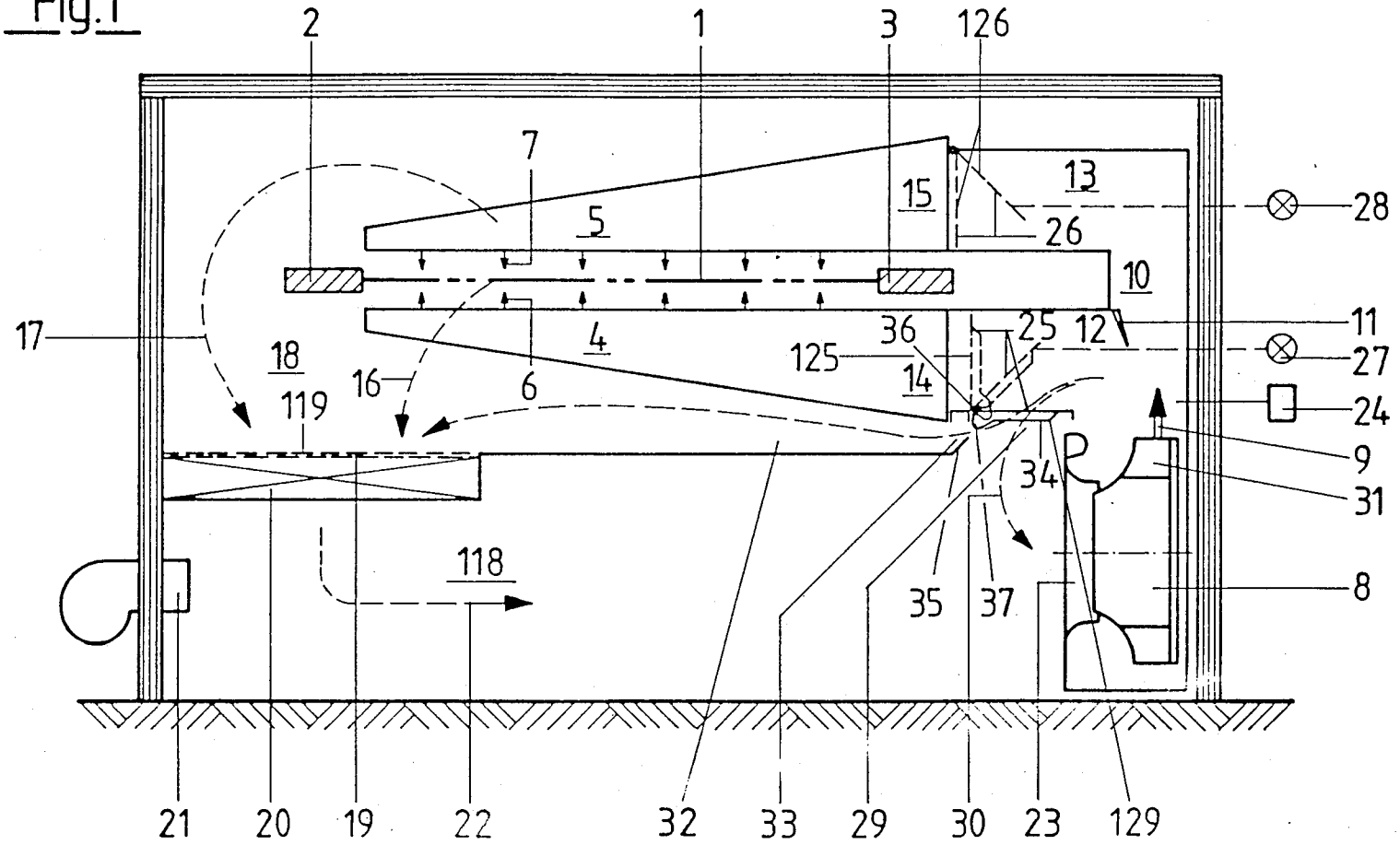
FIG. 1 is a vertical cross-section as viewed perpendicularly to the longitudinal direction of a tenter frame incorporating the preferred embodiment of the preferred invention.

Referring now to the accompanying drawings and initially to FIG. 1, in the tenter frame operation illustrated, a fabric web 1 is held by tenter frame clamping chains 2,3 at its longitudinal edges and drawn in the direction vertical to the plane of the figure between a pair of application chambers 4,5. The application chambers 4,5 are disposed in parallel facing relation and extend on the top and lower sides of the fabric web 1 transverse to its direction of feed. The application chambers 4,5 each have a plurality of hole or slot-type outlets or nozzles for directing the flow of treatment gas onto the fabric web 1 from the top in the direction indicated by arrow 6 and from the lower in the direction indicated by arrow 7. The treatment gas is supplied by a fan 8 in arrow direction 9 to the distribution chamber 10 upstream of the application chambers 4,5. A deflector 11 is mounted in the distribution chamber 10 and in normal machine operation the treatment gas is divided by the deflector 11 and enters the outlets 12,13 of the distribution chamber 10, which lead to the application chamber inlets 14,15. The treatment gas flows out of the application chambers 4,5 in the directions indicated by arrows 6 and 7 onto the fabric web 1, which deflects the treatment gas downward in arrow direction 16 and upward in arrow direction 17 into an enclosure 18. From there, the treatment gas travels through a lint filter 19 and into a return flow chamber 118. The treatment gas may travel through a heat exchanger 20 in passing through the opening 119 in the return flow chamber 118 communicating with the enclosure 18, or it may flow past a gas burner 21 in arrow direction 22 back to the intake side 23 of the fan 8. The temperature of the treatment gas is continuously monitored during circulation with a thermometer 24. The thermometer 24 has a control link to the energy supply source of either the heat exchanger 20 or the gas burner 21.

The application chamber inlet openings 14,15 can be partially or completely closed by a flow control means 25,26. Conventional motor drives 27,28 or a common drive system may be provided to actuate the flow control means 25,26 to vary the opening of the inlets 14,15 between open and closed as desired or as required by the machine. The flow control means 25,26 includes inlet control portions 125,126 which are moveable to open and close the inlets 14,15 and to vary the flow therethrough by movement between positions opening, closing and varying the opening of the inlets 14,15. The inlet control portions 125,126 may operate independently or cooperatively and may be in the same or different operating positions. In order to make it possible for the fan 8 to operate independently of the opening positions of the inlet control portions 125,126 a by-pass opening 29 is provided in the distribution chamber 10 adjacent the lower application chamber inlet 14. The by-pass opening 29 leads directly to the intake side 23 of the fan 8 and is about the size and shape of the lower application chamber inlet 14. The lower flow control means 25 also includes a by-pass opening control portion 129, integrally formed with the inlet control portion 125 of the lower application chamber inlet 14. Therefore, the inlet control portion 125 of the lower application chamber inlet 14 is moveable to open and close the lower inlet 14 and to vary the flow of treatment gas therethrough by movement between positions opening, closing and varying the opening of the lower inlet 14, and the by-pass opening control portion 129 is moveable to open and close the by-pass opening 29 and to vary the flow of treatment gas therethrough by movement between positions opening, closing and varying the opening of the by-pass opening 29 inversely to the opening, closing and varying of the opening of the lower inlet 14 by the lower inlet control portion 125. The by-pass opening 29 provides a short-circuit loop 30 for the treatment gas to pass from the delivery side 31 of the fan 8 directly to its intake side 23 without passing through the application chambers 4,5 or return flow chamber 118 where it would be reheated.

If the inlet control portions 125,126 are not in position to completely close the inlets 14,15, a portion of the treatment gas still flows on the normal route to the fabric web 1 and from there into the enclosure 18 and through the return flow chamber 118 and the heating system 20 or 21 back to the fan 8. The setpoint temperature of the treatment gas is monitored at the output of the fan 8 by the thermometer 24, and the lower flow control means 25 can be moved to provide the proper blending of partial streams 22 and 30 to maintain the desired temperature. If the inlet control portions 125,126 are positioned to completely close the inlets 14,15 of the application chambers 4,5, the treatment gas will circulate according to circuit loop 30 through the fan 8, and the treatment gas will cool down because it no longer passes through the heating system 20 or 21. In order to avoid this disadvantage of the prior art and to have adequately heated treatment gas when the inlet control portions 125,126 are positioned to completely close the inlets 14,15, the machine as illustrated in FIG. 1 is provided with a by-pass branch channel 32 that leads from the distribution chamber 10 directly to the opening 19 in the return flow chamber 118 and the heating system 20 or 21 therewithin. The gas supplied through the branch channel 32 travels from the heating system 20 or 21 in arrow direction 22 back into the short-circuit loop 30 where the two streams are admixed to maintain the proper treatment gas temperature as governed by the thermometer 24.

The opening 33 of the branch channel 32 adjacent the by-pass opening 29 is open only when the inlet control portions 125,126 are positioned beyond an intermediate extent to close the application chamber inlets 14,15 from approximately half closed to substantially completely closed when the machine is stopped. When the inlet control portions 125,126 are positioned to vary the opening of the inlets 14,15 between open and open to the intermediate extent, thereby to throttle the flow of treatment gas into the application chambers 14,15, the branch channel inlet 33 is maintained closed to prevent the treatment gas from flowing into the branch channel 32 and overheating the internal machine components, walls and doors during periods of time when the machine is being operated in a throttled condition, such as during a slow down or a brief stop.

Figure 2:
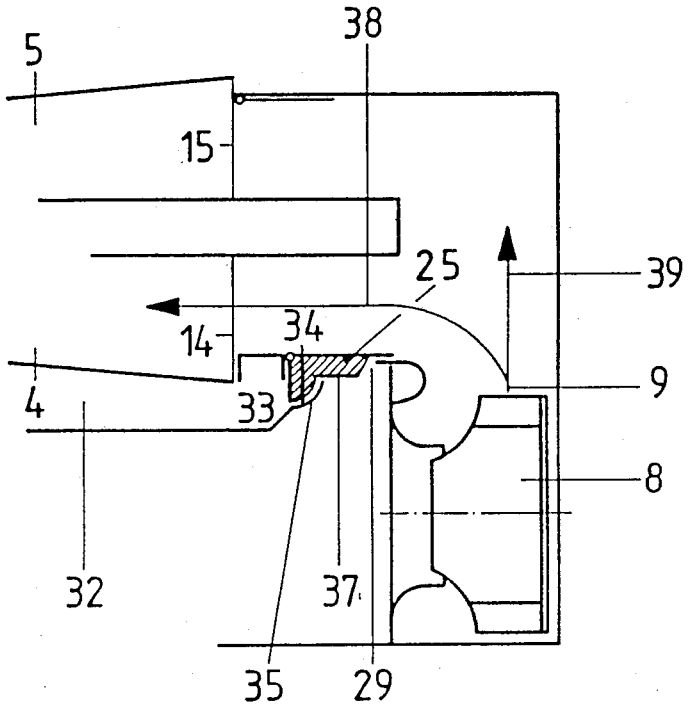
FIGS. 2 and 4 are enlargements of the control means of FIG. 1 shown in varying positions.
Figure 3:
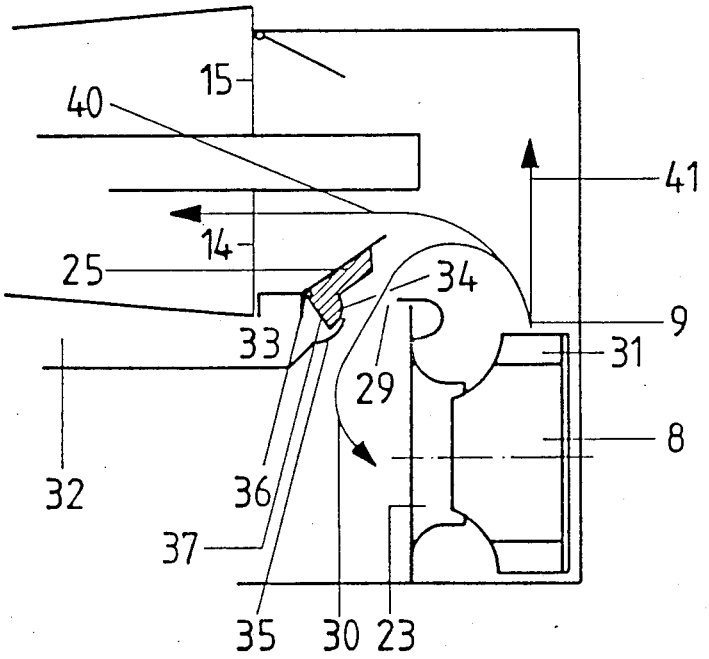
Figure 4:
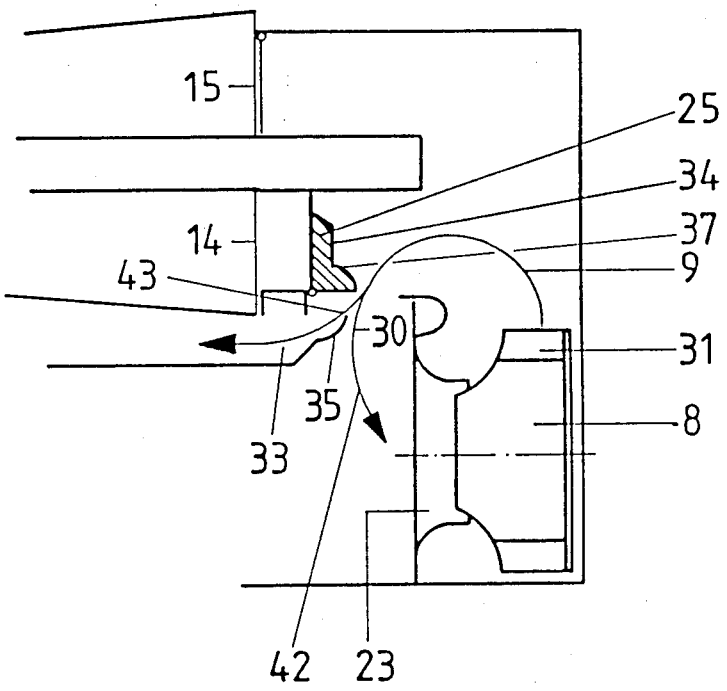

Referring to FIGS. 2 to 4, in the preferred embodiment, the opening 33 of the branch channel 32 has an arcuate surface 35 which corresponds to the arcuately shaped segment 34 of the branch channel control portion 37 which is integrally formed with the lower inlet control portion 125 and the by-pass opening control position 129 to define the lower flow control means 25. The opening 33 is maintained closed when the lower application chamber inlet 14 is about half to fully open for a continuous throttle operation, and the opening 33 is not completely open until the lower application chamber inlet 14 is substantially completely closed (that is, when the machine is stopped). In other words, this means that the arcuately shaped segment 34 of the branch channel control portion 37 of the lower flow control means 25 facing the opening 33 of the branch channel 32, and the arcuate surface 35 of the branch channel opening 33 engage tightly when the lower application chamber inlet 14 is more than about half open. In the preferred embodiment, the surface 35 of the branch channel opening 33 is arcuate for this purpose on the side facing the lower flow control means 25. The lower flow control means 25 is pivotally mounted in the distribution chamber 10. The arcuate surface of limited extent of the segment 34 of the branch channel control portion 37 of the lower flow control means 25 is adapted for movement in relation to the arcuate surface 35 of the branch channel opening 33 during pivotal movement of the integrally formed flow control means 25.

Three different pivoting positions of the integrally formed flow control means 25 are shown schematically in FIGS. 2 to 4. FIG. 2 shows the case of the fully open lower application chamber inlet 14 with the correspondingly fully closed by-pass opening 29. The treatment gas delivered by the fan 8 travels in arrow directions 9 and 38 to the lower application chamber 4 and, with the upper application chamber inlet 15 also open, the treatment gas also travels in arrow direction 39 to the upper application chamber 5. FIG. 2 thus illustrates the normal operation of the machine with the stream of treatment gas being utilized to its full capacity. If the supply of the treatment gas to the lower application chamber 4, and, if desired, to the upper application chamber 5 as well, is to be throttled continuously or even briefly for any reason, the associated inlet control portions 125,126, as necessary, are pivoted to the positions desired to partially close the application chamber inlets 14,15. The flow control means 25,26 are pivoted to varying positions by conventional means 28,29 for pivoting such control members in response to desired treatment of the fabric web 1. FIG. 3 illustrates a limiting position for a continuous throttle operation. The lower flow control means 25 is pivoted about its axis 36 so far in front of the application chamber inlet 14 that only a partial stream 40 of the entire stream 9 of treatment gas coming from the fan 8 can enter the lower application chamber 4. A corresponding partial stream, indicated by arrow 41, of gas can also be conducted to the upper application chamber 5. The remaining partial or main stream 42 of the treatment gas travels in the short-circuit loop 30 directly through the by-pass opening 29 from the exhaust side 31 to the intake side 23 of the fan 8. Referring to FIG. 3, in the limiting position of the lower flow control means 25 the opening 33 of the branch channel 32 remains closed due to the engagement of the arcuate surface 35 of the branch opening 33 and the segment 37 of the integrally formed lower flow control means 25. The branch channel opening 33 is opened only when the lower inlet control portion 125 of the flow control means 25 closes the lower application chamber inlet 14 substantially as shown in FIG. 4 when the machine and fabric web 1 are stopped and when the limiting position for the continuous throttle operation is exceeded as illustrated in FIG. 3. When the machine is stopped a partial stream 43 of the short-circuit loop 30 can flow into the opening 33 of the branch channel 32 to the return flow chamber 118 for reheating or conditioning by the heat exchanger 20 or the gas burner 21 and then on the usual route to the intake side 23 of the fan 8. In this way, the main stream 42 of the treatment gas flowing in the short-circuit 30 can be held at the desired treatment temperature by admixing with the heated partial stream 43.

Referring again to FIG. 3, the arcuate surface of the segment 34 of the branch channel control portion 37 and the arcuate surface 35 of the branch channel opening 33 are appropriately dimensioned so that when the partial stream 40 of gas flowing through the lower application chamber 4 goes below a certain minimum temperature, the opening 33 is opened so as to keep the entire volume of treatment gas flowing through the heat exchanger 20 or past the gas burner 21 just great enough so that a blending temperature corresponding to the set-point of thermostat 24 can be continuously maintained by the positioning of the flow control means 25. The flow control means 25,26 are adapted so that the drives 28 and 29 regulate the opening cross-section of the lower and upper application chambers 14,15 only in certain positions of the flow control means 25,26 corresponding to the positions between those illustrated in FIGS. 2 and 3 and, from the flow control means 25 position illustrated in FIG. 3 to the flow control means 25 position illustrated in FIG. 4, the flow control means 25,26 close the application chamber inlets 14,15 discontinuously in one move. In this manner, the opening 33 of the branch channel 32 is either open fully or not at all.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A convection heat treating apparatus for thermal treatment of a traveling substrate, such as drying or heat setting of a traveling web of textile material with a treatment gas, said apparatus comprising:

an enclosure through which said substrate travels and within which treatment gas circulates, a pair of application chambers within said enclosure arranged in essentially parallel spaced facing relation on opposite sides of said traveling substrate, said application chambers having inlets for receipt of treatment gas within said chambers and outlets through which treatment gas is applied from said application chambers onto said substrate, a distribution chamber communicating with said pair of application chambers through said inlets for distribution of said treatment gas to said application chambers, means for circulating treatment gas through said distribution chamber and said application chambers onto said traveling substrate, a return flow chamber having an opening in said enclosure for receiving treatment gas after application onto said substrate for flow of said treatment gas through said return flow chamber to said circulating means for recirculation of said treatment gas, a branch opening in said distribution chamber to allow passage of treatment gas from said distribution chamber to said opening in said return flow chamber without passing through said application chambers, and a flow control means for regulating flow of treatment gas from said distribution chamber into said application chambers and for controlling flow of treatment gas through said branch opening, said flow control means being adapted to vary the opening of said inlet between closed and open and to maintain said branch opening closed when said inlet opening is varied between open and partially opened to an intermediate extent and to open said branch opening when said inlet is closed from said intermediate extent.

2. An apparatus according to claim 1 and characterized further in that said flow control means progressively opens said branch opening while progressively closing said inlet from said intermediate extent.

3. An apparatus according to claim 1 and characterized further in that said flow control means includes an application chamber inlet control portion and a branch opening control portion, said inlet control portion being movable to open and close said inlet, and to vary flow therethrough by movement between positions opening, closing and varying the opening of said inlet, and said branch opening control portion being moveable to open and close said branch opening and to vary flow therethrough by movement between positions for maintaining said branch opening closed when said inlet control portion is moved between positions for varying said inlet opening between open and said intermediate extent and to progressively open said branch opening when said inlet control portion is moved between positions for progressively closing said inlet from said intermediate extent.

4. An apparatus according to claim 3 and characterized further in that said branch opening control portion has a segment to maintain said branch opening closed during movement of said branch opening control portion corresponding to movement of said inlet control portion between open position and said intermediate extent and to progressively open said branch opening when said inlet control portion is moved between positions for progressively closing said inlet from said intermediate extent.

5. An apparatus according to claim 4 and characterized further in that said branch control portion is pivotally mounted in said distribution chamber proximal said branch opening and said segment of said branch opening control portion has an arcuate surface of limited extent adapted for movement in relation to said branch opening during pivotal movement of said branch control portion to maintain said branch opening closed when said inlet opening is varied between open position and said intermediate extent and to open said branch opening when said limited extent arcuate surface of said segment is pivotally moved from said branch opening to progressively open said opening while said inlet is progressively closed from said intermediate extent.

6. An apparatus according to claim 5 and characterized further in that said branch opening has an arcuate surface corresponding with said limited extent arcuate surface of said segment disposed in adjacent opposed facing relation with said arcuate surface of said segment when said application chamber inlet control portion is in position for said inlet opening to be completely open, said arcuate surface of said segment being adapted for movement in relation to said arcuate surface of said opening while maintaining said branch opening substantially closed during pivotal movement of said branch control portion when said application chamber inlet control portion is positioned to vary said inlet opening between open position and said intermediate extent.

7. An apparatus according to claim 6 and characterized further in that said intermediate extent position is approximately mid-way between the positions of said inlet control portion for substantially opening and substantially closing said inlet opening.

8. An apparatus according to either of claims 3,4 or 5 and characterized further in that said application chamber inlet control portion is integrally formed with said branch control portion.

9. An apparatus according to claim 8 and characterized further in that said inlet of said application chamber is adjacent said branch opening with said integrally formed portions being pivotally mounted between said application chamber inlet and said branch opening.

10. An apparatus according to claim 1 and characterized further by means for heating said treatment gas in said return flow chamber.

11. An apparatus according to claim 10 and characterized further by a by-pass opening in said distribution chamber adjacent said circulating means between said circulating means and said heating means to allow recirculation of at least a portion of said treatment gas without being heated to control the temperature of said treatment gas, and said flow control means being adapted to vary the opening and closing of said by-pass opening inversely to the opening and closing of said application chamber inlet.

12. An apparatus according to claim 11 and characterized further in that said flow control means includes an application chamber inlet control portion and a by-pass opening control portion, said inlet control portion being moveable to open and close said inlet and to vary flow therethrough by movement between positions opening, closing and varying the opening of said inlet, and said by-pass control portion being moveable to open and close said by-pass opening and to vary flow therethrough by movement between positions opening, closing and varying the opening of said opening inversely to the opening, closing and varying the opening of said inlet by said inlet control portion.

13. An apparatus according to claim 12 and characterized further in that said inlet control portion and said by-pass control portion are integrally formed.

14. An apparatus according to claim 13 and characterized further in that said flow control means includes an application chamber inlet control portion and a branch opening control portion, said inlet control portion being moveable to open and close said inlet and to vary flow therethrough by movement between positions opening, closing and varying the opening of said inlet and said branch opening control portion being moveable to open and close said branch opening and to vary flow therethrough by movement between positions for maintaining said branch opening closed when said inlet control portion is moved between positions for varying said inlet opening between open and said intermediate extent and to progressively open said branch opening when said inlet control portion is moved between positions for progressively closing said inlet from said intermediate extent.

15. An apparatus according to claim 14 and characterized further in that said branch opening control portion has a segment to maintain said branch opening closed during movement of said branch opening control portion corresponding to movement of said inlet control portion between open position and said intermediate extent and to progressively open said branch opening when said inlet control portion is moved between positions for progressively closing said inlet from said intermediate extent.

16. An apparatus according to claim 15 and characterized further in that said branch control portion is integrally formed with said inlet control portion and said by-pass control portion to define an integrally formed control member.

17. An apparatus according to claim 16 and characterized further in that said integrally formed control member is pivotally mounted in said distribution chamber intermediate said application chamber inlet and said branch opening with said by-pass opening being disposed radially outwardly of said branch opening to provide opening and closing of said inlet inversely to opening and closing of said branch and by-pass openings by pivoting of said control member.

18. An apparatus according to claim 17 and characterized further in that said branch opening has a cross-section approximately one-tenth the cross-section of said by-pass opening.

19. An apparatus according to claim 17 and characterized further in that said branch control portion is pivotally mounted in said distribution chamber proximal said branch opening and said segment of said branch opening control portion has an arcuate surface of limited extent adapted for movement in relation to said branch opening during pivotal movement of said branch control portion to maintain said branch opening closed when said inlet opening is varied between open and said intermediate extent and to open said branch opening when said limited extent arcuate surface of said segment is pivotally moved from said branch opening to progressively open said opening while said inlet is progressively closed from said intermediate extent.

20. An apparatus according to claim 18 and characterized further in that said intermediate extent position is approximately mid-way between the positions of said inlet control portion for substantially opening and substantially closing said inlet opening.

* * * * *